US006735823B2

(12) United States Patent
Pelletier

(10) Patent No.: US 6,735,823 B2
(45) Date of Patent: May 18, 2004

(54) HINGE

(75) Inventor: Thomas A. Pelletier, Wallingford, CT (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 10/102,212

(22) Filed: Mar. 21, 2002

(65) Prior Publication Data

US 2003/0177607 A1 Sep. 25, 2003

(51) Int. Cl.[7] ..... E05D 7/00; E05D 5/00

(52) U.S. Cl. ..... 16/354; 16/387; 16/251; 16/382

(58) Field of Search ..... 16/354, 387, 250, 16/251, 252, 253, 382, 234; 411/119, 120, 121

(56) References Cited

U.S. PATENT DOCUMENTS 2,072,028 A * 2/1937 Cooper ..... 16/354
3,665,552 A * 5/1972 Toldo et al. ..... 16/251
3,683,453 A * 8/1972 McLeland et al. ..... 16/248
3,695,330 A * 10/1972 Hasbrouck ..... 160/135
4,118,827 A * 10/1978 Yamamoto ..... 16/252
4,232,724 A * 11/1980 Brown ..... 160/135
4,825,508 A * 5/1989 Post, Jr. ..... 16/250
4,958,643 A * 9/1990 Pansiera ..... 602/16
4,976,008 A * 12/1990 Baer ..... 16/354
5,062,181 A 11/1991 Bobbowski et al.
5,095,582 A * 3/1992 Ohlsson ..... 16/235
5,337,451 A 8/1994 Goossens
5,385,383 A * 1/1995 Kreis et al. ..... 296/202
5,490,306 A * 2/1996 Floyd et al. ..... 16/250
5,685,045 A 11/1997 Lace
6,170,210 B1 1/2001 Marts
6,209,172 B1 * 4/2001 Bradley ..... 16/261
6,286,185 B1 9/2001 Ramsauer
6,318,036 B1 11/2001 Siudzinski et al.

FOREIGN PATENT DOCUMENTS

DE 19900267 A1 * 1/1999

* cited by examiner

*Primary Examiner*—Chuck Y. Mah
(74) *Attorney, Agent, or Firm*—Pillsbury Winthrop LLP

(57) ABSTRACT

A hinge is disclosed providing capability to prevent or minimize spinning and/or moving of hinge fasteners. The hinge comprises a pair of abutting hinge leaves each having an aperture. A hinge leaf has at least one fastener engaging surface disposed on the hinge leaf in adjacent relationship to the aperture of the hinge leaf, the at least one engaging surface being spaced from the aperture of the hinge leaf so as to engage a fastener inserted into the aperture from spinning.

46 Claims, 12 Drawing Sheets

HINGE

BACKGROUND

1. Field of the Invention

The present invention relates to hinges.

2. Description of Related Art

Hinges, such as butt-type door hinges, are well known. Continuous hinges of the type utilizing intermeshing gear teeth have received considerable acceptance for a number of applications, particularly for relatively durable and high strength hinged connections, or where some sealing action is desired. Such hinges are illustrated and described, for example, in Bobbowski U.S. Pat No. 5,062,181 and Baer U.S. Pat Nos. 3,092,870 and 3,402,422.

Unlike traditional butt hinges, continuous hinges are generally applied to the entire length of a door. Further, continuous hinges come in several configurations. The full surface continuous hinges have hinge leaves that are respectively applied to the surface of the door and the surface of the doorframe. The half-surface continuous hinges have hinge leaves that are respectively applied to the surface of the door and to the inside portion of the doorframe. The fasteners typically used to apply continuous hinges are through bolts for the door and through bolts and/or self-tapping screws for the doorframe. Through bolts used to apply continuous hinges typically have a round head and a knurl below the head.

When mounting a continuous hinge to a door (and/or doorframe), the through bolt is typically inserted through the hinge into the door face (and/or doorframe) and then fastened with a nut on the opposite side of the door. The knurl below the head of the through bolt is intended to hold the through bolt in place in the hole through the door (and/or doorframe) to allow the nut to be fastened thereon. However, often the through bolt is not held in place by the knurl and begins to spin such that the nut cannot be properly fastened to the through bolt. Often, another person is required to hold the head of the through bolt while the nut is tightened onto the through bolt (or vice versa).

BRIEF DESCRIPTION OF THE DRAWINGS

Exemplary embodiments of the invention are illustrated in the accompanying drawings in which like references indicate similar or corresponding elements and in which.

DETAILED DESCRIPTION

It would be advantageous to provide a hinge capable of preventing or minimizing spinning and/or moving of hinge fasteners. It further would be advantageous to provide a hinge having integral anti-spinning capability for hinge fasteners without requiring additional parts or components. It would also be advantageous to provide a hinge that can be readily and economically fabricated. Further, it would be advantageous to provide a hinge that has anti-spin capability on the side of the door (and/or doorframe) to which the hinge is attached to avoid the need to drill large holes through the door (and/or doorframe) to accommodate anti-spinning capability provided through the hole or requiring extra components to provide anti-spinning on the other side of the door (and/or doorframe) to which the hinge is attached. Furthermore, it would be advantageous to substantially provide threaded engagement for hinge fasteners within the door (and/or door frame) to which the hinge is affixed thereby avoiding the need for large fasteners protruding from the door (and/or doorframe) to provide such threaded engagement.

Figure 1:
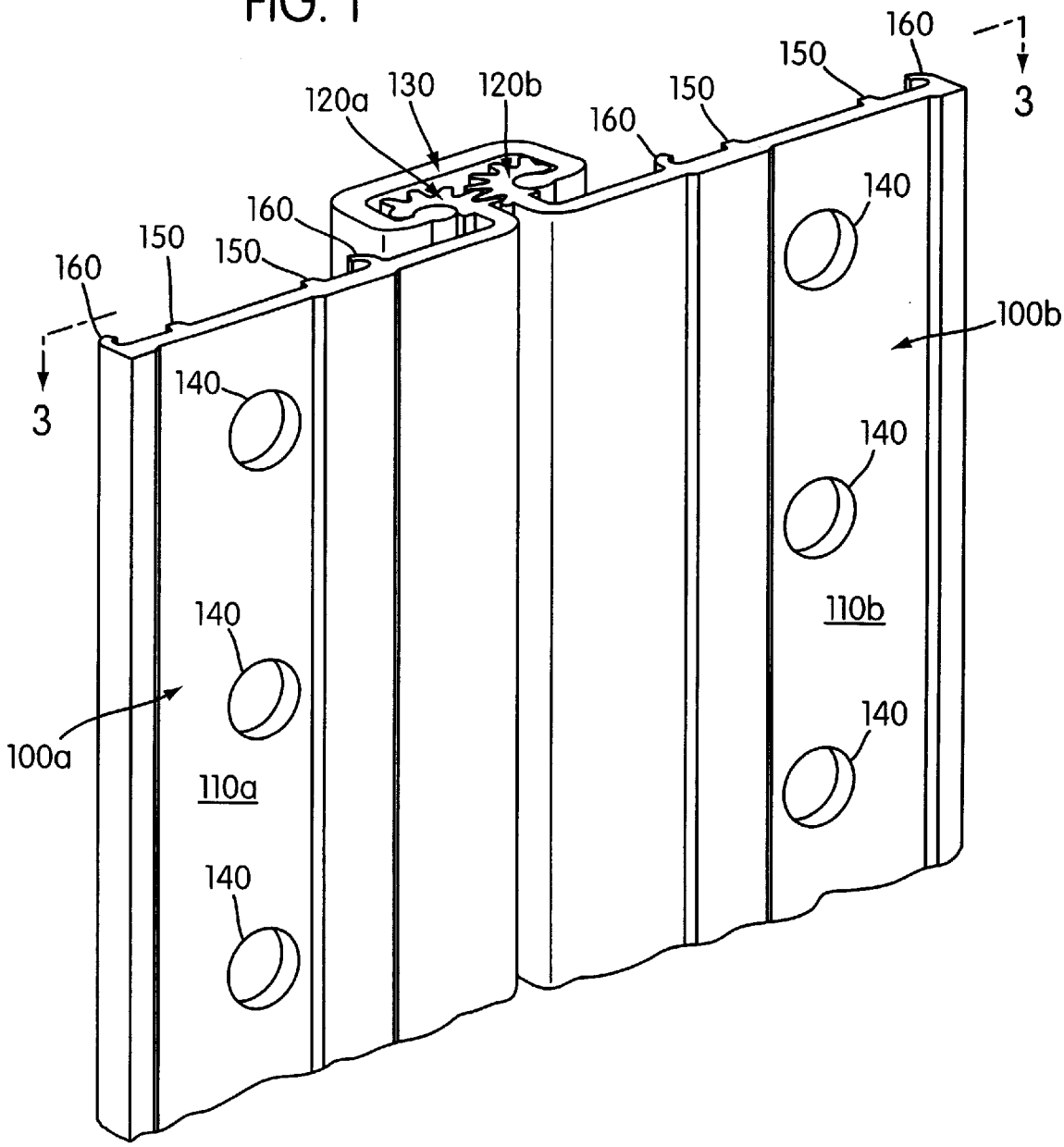
FIG. 1 is a fragmentary perspective view of a hinge according to at least one embodiment of the present invention.
Figure 2:
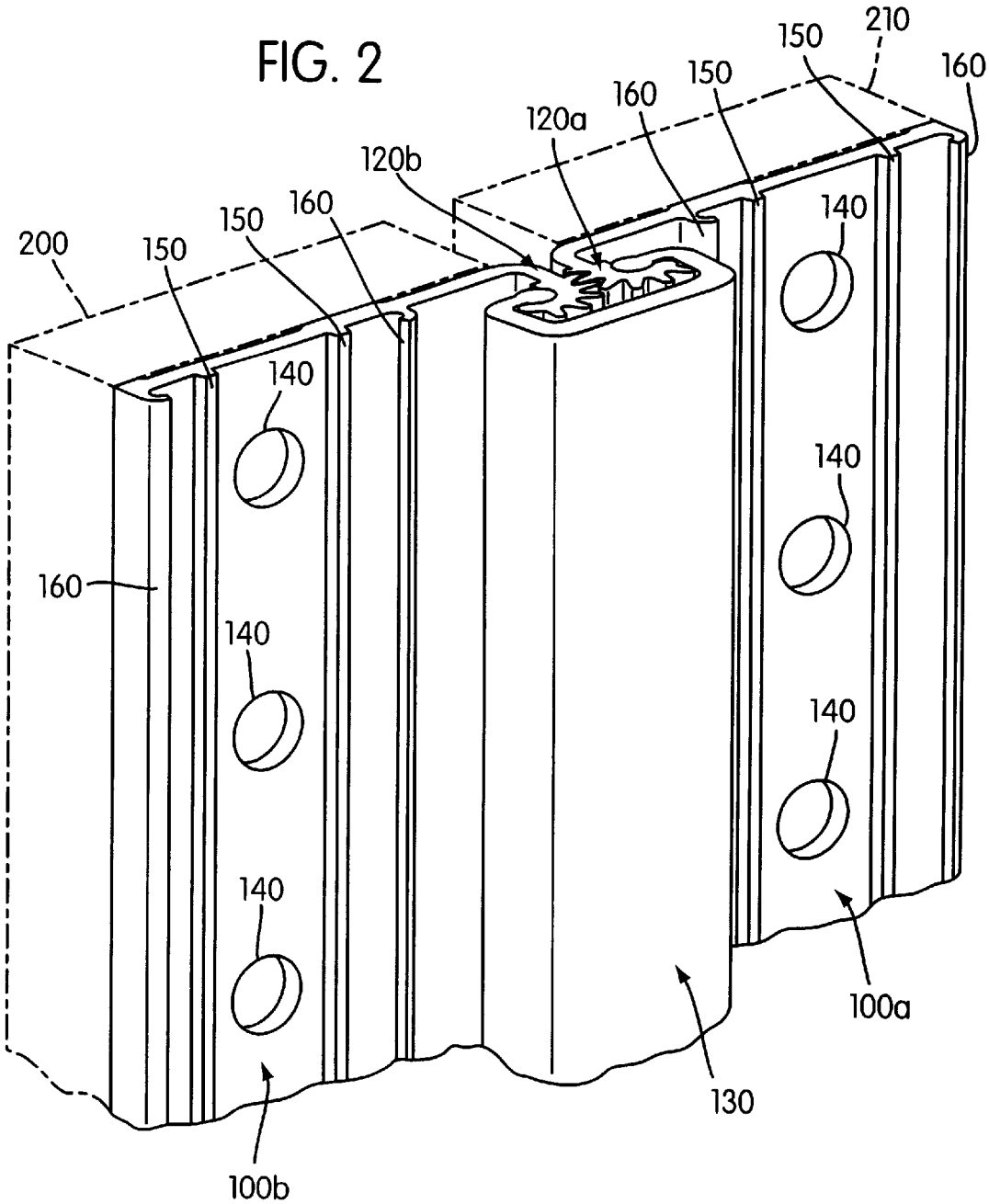
FIG. 2 is a fragmentary perspective view of the hinge of FIG. 1, as mounted upon a door frame to provide pivotal support for a door, the door and door frame shown in phantom line.

Turning first to FIGS. 1 and 2, a continuous hinge according to at least one embodiment of the present invention comprises a pair of elongated hinge leaves generally designated by the numeral 100, each having a substantially planar mounting portion 110 and a pivot portion generally designated by the numeral 120. The pivot portions of the opposed hinge leaves are held together in engagement by a lateral bearing member generally designated by the numeral 130. The hinge leaves further comprise one or more apertures 140 used for securing the hinge leaves to underlying structures using fasteners (not shown in FIG. 1) extending through the apertures. In FIG. 2, a first hinge leaf 100*b* is shown as mounted upon the jamb or mounting structure 200 of a door frame and a second hinge leaf 100*a* is shown as mounted upon a door or door structure 210. In at least one embodiment, a door assembly may be provided comprising a mounting structure, a door structure, a hinge as described herein and fasteners for mounting the hinge to the mounting and door structures.

Figure 3:
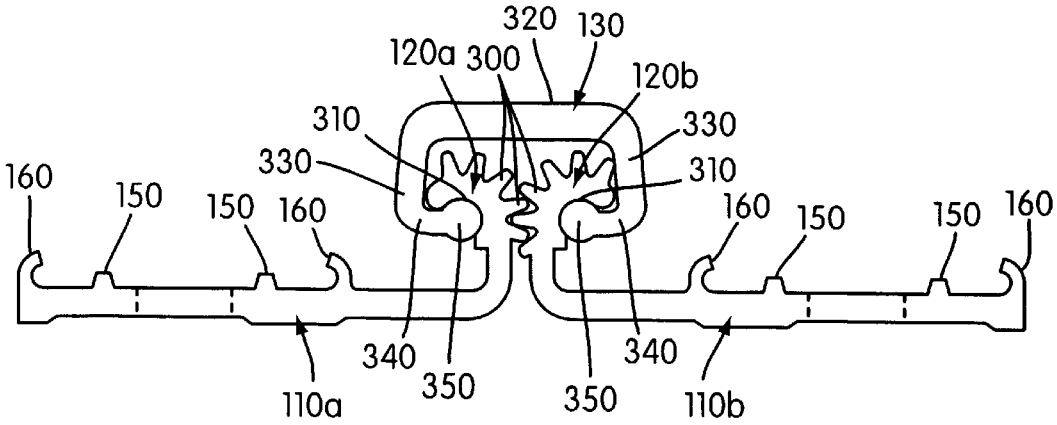
FIG. 3 is a fragmentary sectional view of the hinge of FIGS. 1 and 2 to an enlarged scale and along the line 3—3 of FIGS. 1 and 2.

As best seen in FIG. 3, the pivot portions of the hinge leaves of a continuous hinge according to at least one embodiment of the invention are of generally arcuate C-shaped configuration with a series of gear teeth 300 extending axially along its convex outer surfaces, and with arcuate recesses 310 in their concave inner surfaces. The lateral bearing member is of generally C-shaped cross section providing a box-like configuration defined by a web 320, diverging legs 330 and opposed flanges 340 which terminate in circular bosses 350. As can be seen, the bosses are cooperatively configured and dimensioned so as to slide into the arcuate recesses of the pivot portions of the hinge leaves and thereby lock the gear teeth of the pivot portions in intermeshing engagement while permitting relative pivotal movement of the hinge leaves thereabout. Although not required, the lateral bearing member generally extends the full axial length of the hinge to provide both a closure surrounding the pivot portions of the hinge as well as the means for retaining the hinge leaves in assembly.

Referring to FIGS. 1–3, two spaced-apart ribs 150 are positioned on opposite sides of the apertures of the hinge leaves. In this embodiment, the ribs are formed on the hinge leaves although as will be apparent to those skilled in the art, the ribs could be otherwise provided on the hinge leaves, for example, by welding. The ribs are disposed on the hinge leaf in adjacent relationship to the apertures, the ribs being spaced from the apertures so as to engage fasteners inserted into the apertures from spinning. For example, in FIGS. 1–3, the ribs are positioned and spaced-apart on the opposite sides of the apertures of the hinge leaves so as to hold the edges of or facets on a fastener inserted through the apertures. Alternatively, the ribs may simply comprise a single rib positioned adjacent to the apertures so as to hold an edge of or facet on a fastener inserted through the apertures. Through appropriate spacing in relation to the fastener used in the hinge, the ribs keep the fastener from spinning or moving. The hinge ribs can provide an anti-spinning capability for hinge fasteners (such as through bolts) without requiring additional parts or components (such as a bushing or a lock washer).

Figure 4:
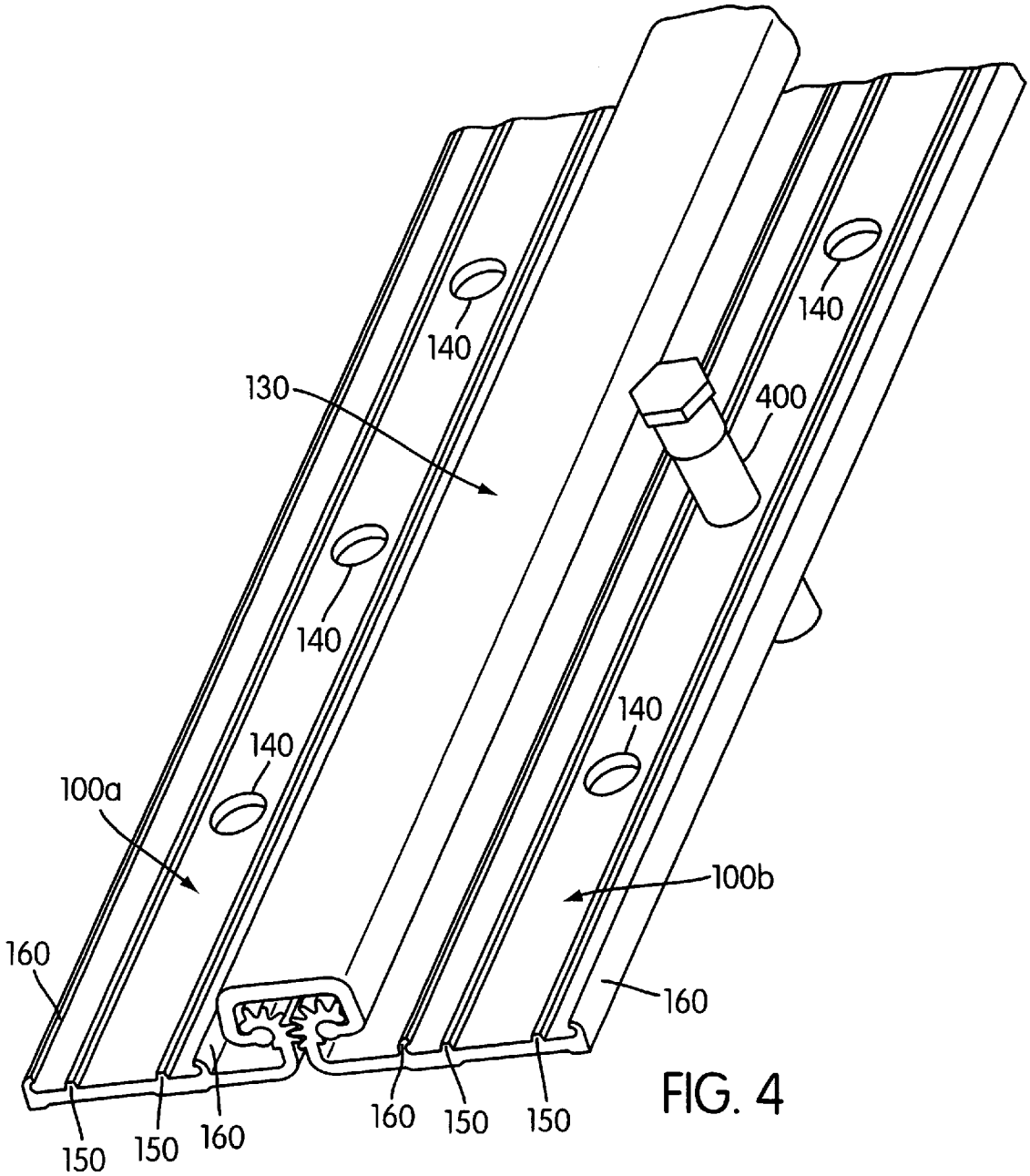
FIG. 4 is a fragmentary perspective view of the hinge of FIG. 1 showing a fastener being inserted through one of the apertures of the hinge.

In FIG. 4, a perspective view of a continuous hinge according to at least one embodiment of the invention is shown with a fastener generally designed by the numeral 400 being inserted through one of the apertures of the hinge. In the embodiment of FIGS. 4–7, a first portion or member of the fastener comprises a hex head member 600 (shown in FIGS. 4–7) and second portion or member of the fastener comprises a corresponding machine screw 610 (shown in FIGS. 6 and 7). The hex head portion 600 has a hollow interior having a cylindrical surface with internal threads. The screw 610 has external threads that can be received through one end of the portion 600 and secured thereto by a rotating action of the screw 610. The screwing action of screw 610 will not rotate the first portion 600 as a result of engagement between the head of portion 600 with the protruding surface 150 on the hinge leaf 100*b*. As will be apparent to those skilled in the art, other types of fasteners, including other types of bolts and/or corresponding nuts and screws, could be used. For example, first portion 600, can be any threaded fastener portion having a head with a facet that can engage the adjacent surface of engaging portion 150 in a manner that will prevent rotation of first portion 600. The second portion 610 can be any structure (e.g., a nut) that can be threadedly secured to the first portion. Indeed, while a hex head type bolt is shown as the first portion of the fastener in FIGS. 4, 5, 6 and 7, other fasteners shaped as or having heads with a non-circular, faceted surface may be used. The head of the second portion can be any type of fastener head including conventional circular, hex, etc. type heads. The hinge leaf 100*a* (FIGS. 1–5) or 100*a* (FIGS. 6–7) may be fixed to a door jamb or frame in any conventional manner, using screws, bolts, adhesive or welds of any conventional type. If, however, the connection is to extend through the full extent of the jamb (e.g., with a metal frame), the benefits of the anti-spinning bolt/hinge leaf can be employed with the jamb 200 as well as the door 210 connection.

Figure 5:
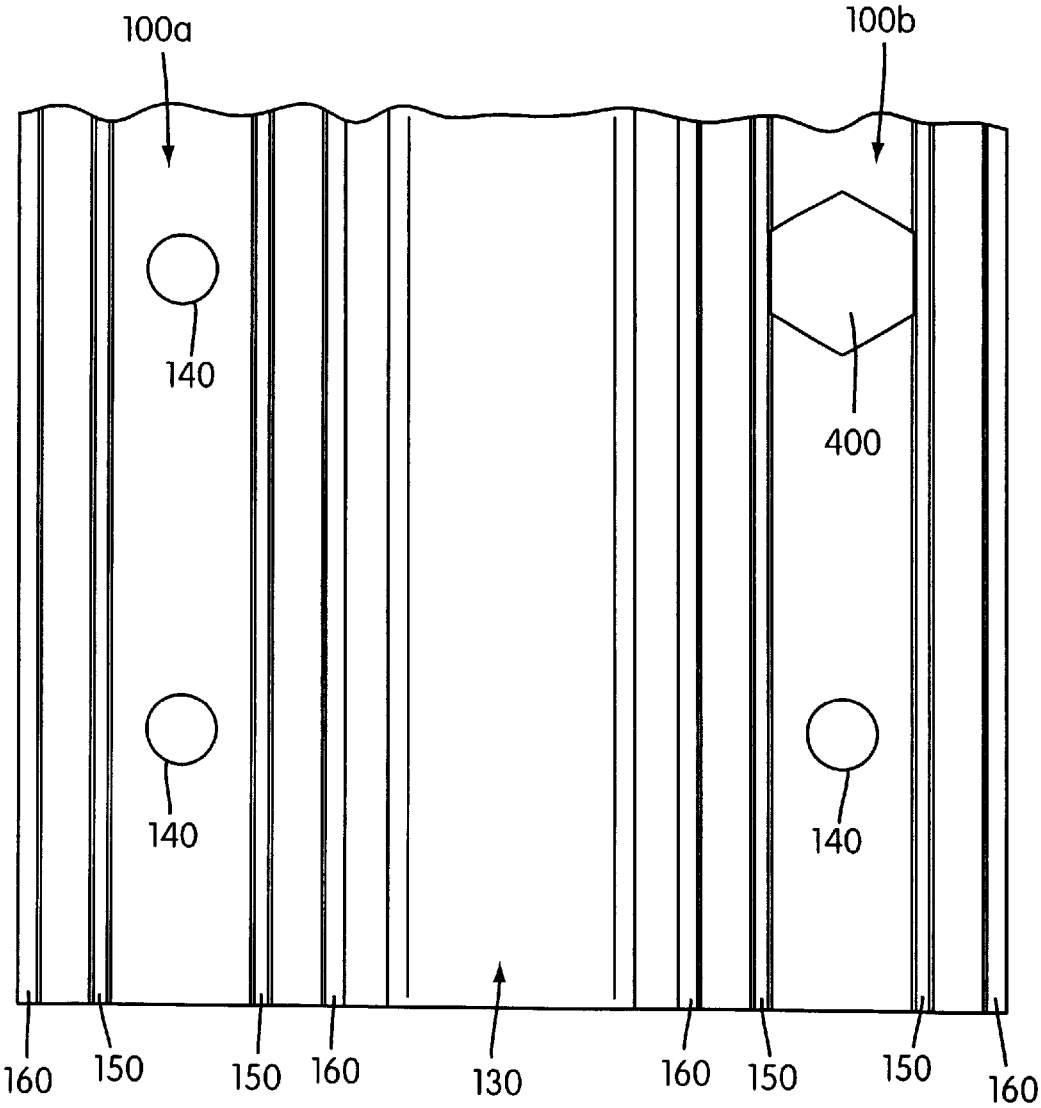
FIG. 5 is a top plan view of the hinge of FIG. 1 showing a fastener inserted through one of the apertures of the hinge.
Figure 6:
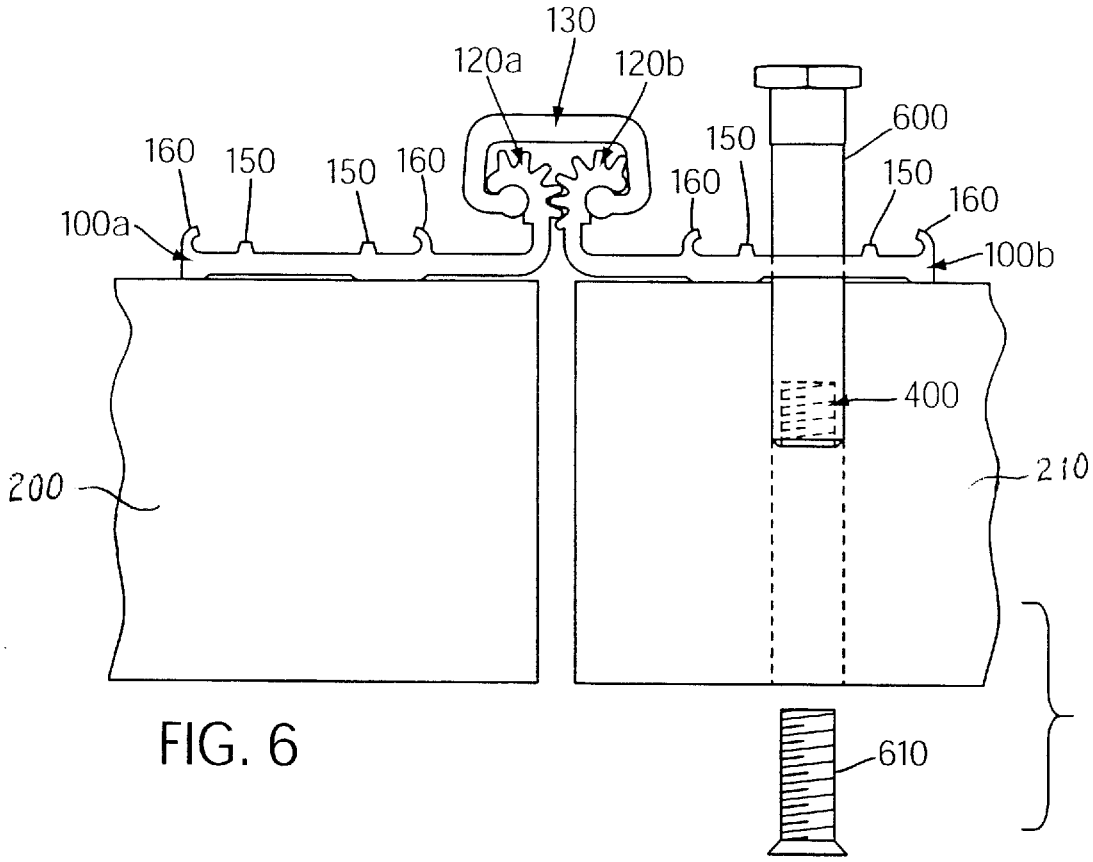
FIG. 6 is a fragmentary sectional view of FIG. 3 showing a fastener being inserted through one of the apertures of the hinge.
Figure 7:
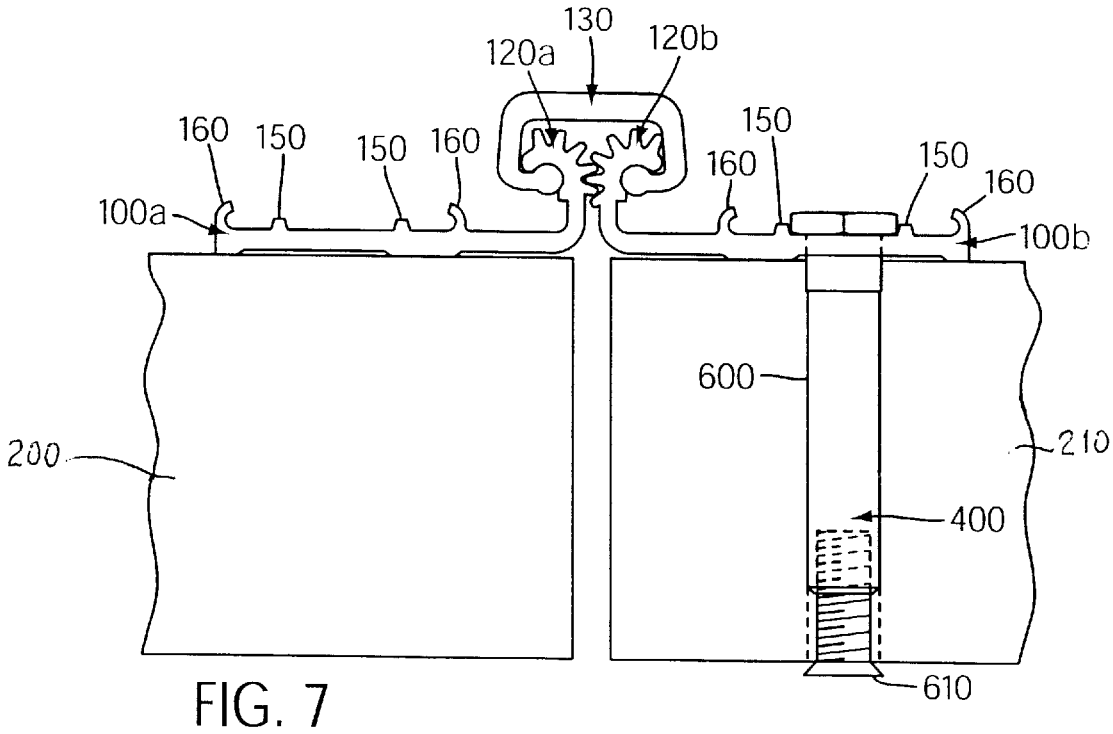
FIG. 7 is a fragmentary sectional view of FIGS. 3 and 6 showing a fastener inserted through one of the apertures of the hinge.
Figure 10:
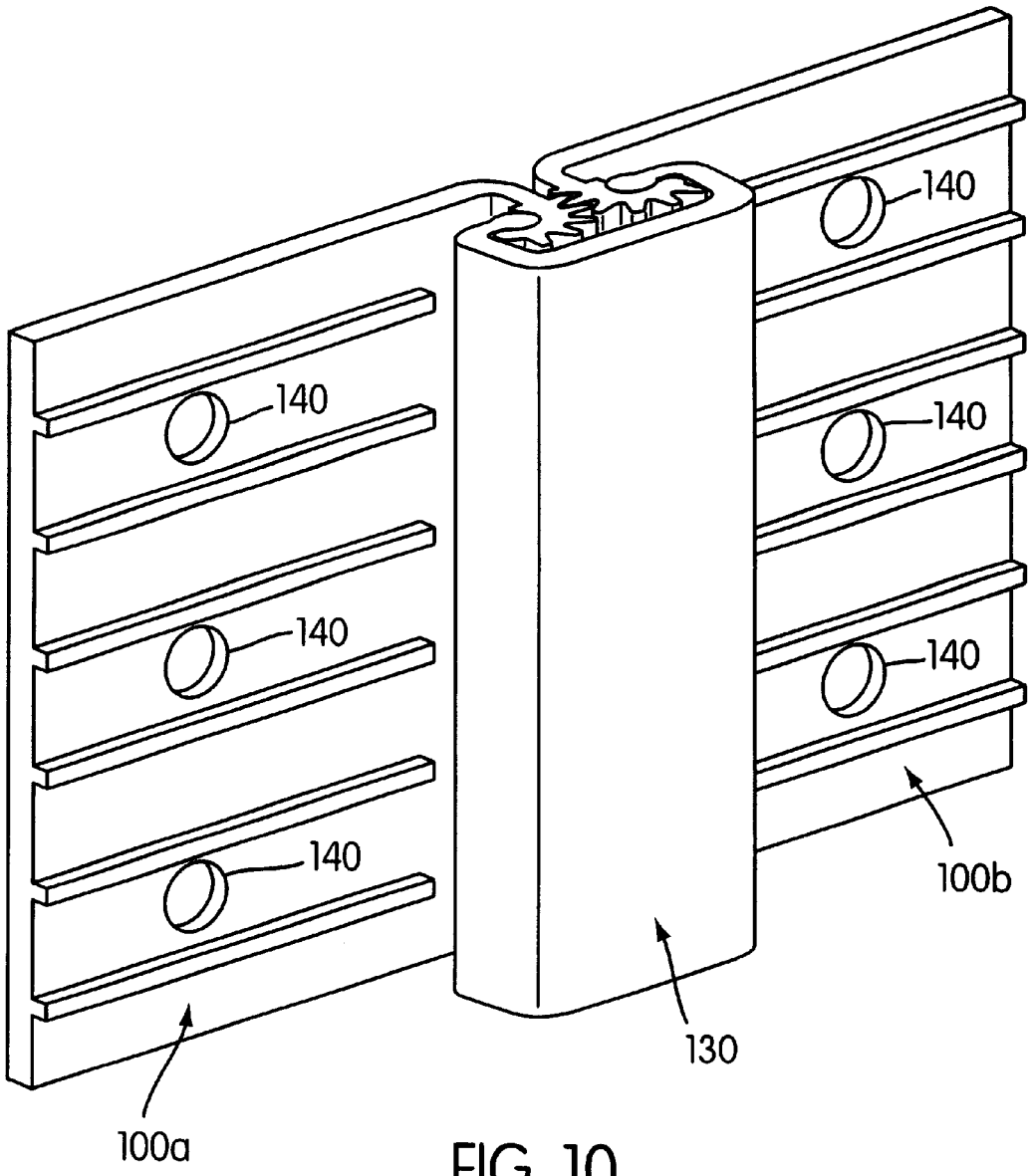
FIG. 10 is a fragmentary perspective view of a hinge having widthwise ribs according to at least one embodiment of the present invention.
Figure 11:
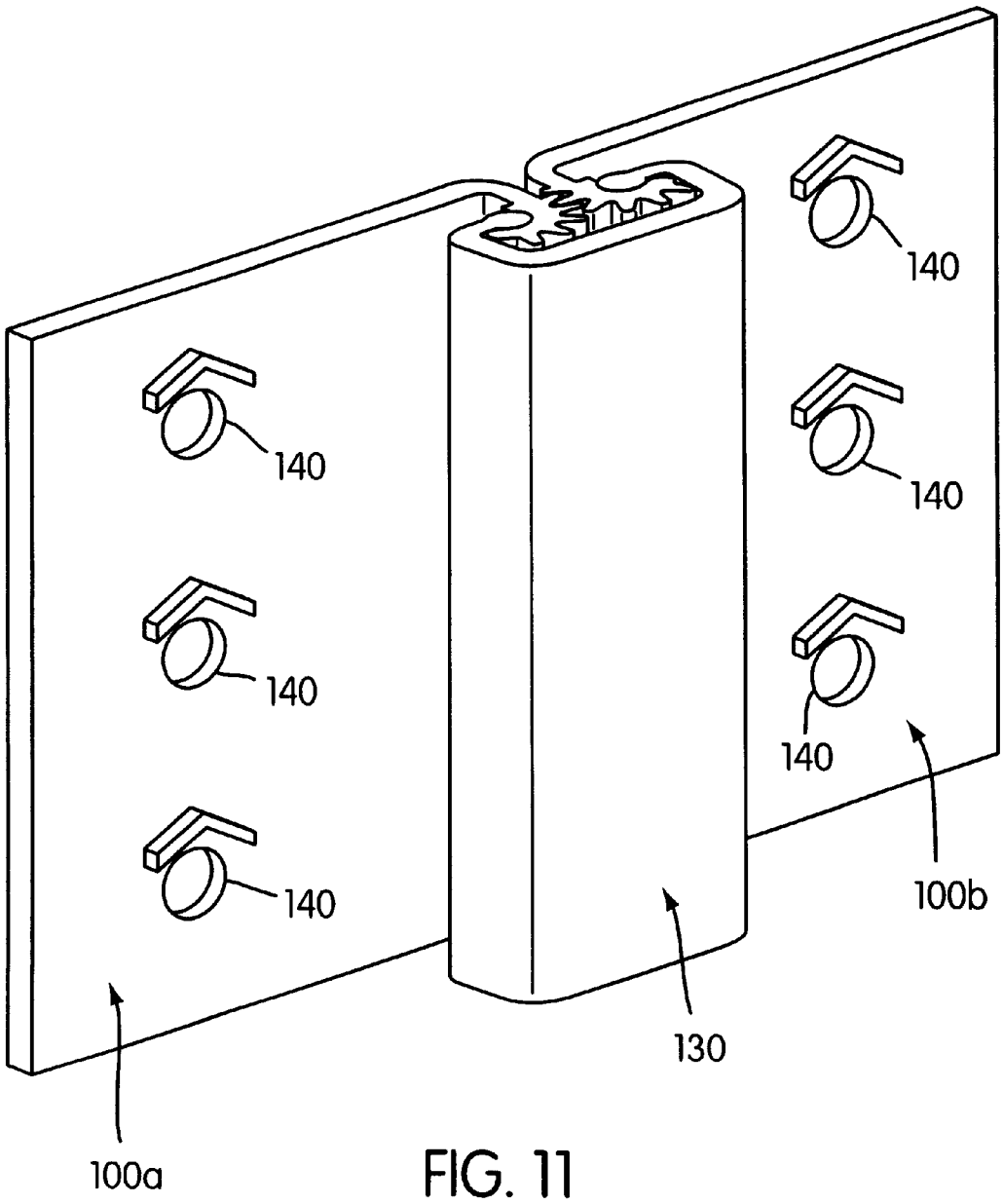
FIG. 11 is a fragmentary perspective view of a hinge having chevron-type ribs according to at least one embodiment of the present invention.

As can be better seen in the top plan view of FIG. 5 of the continuous hinge depicted in FIG. 4, the edges of or facets on the head of the fastener inserted through one of the apertures of the hinge are aligned with the ribs positioned on opposite sides of the one or more apertures of the hinge leaves. When the head of the fastener is so aligned with the ribs and flush with the hinge leave, the fastener is constrained from spinning by the ribs. Referring to FIG. 6, a side view of the continuous hinge of FIGS. 4 and 5 is depicted showing the fastener being inserted through one of the apertures of the hinge. In FIG. 7, another side view of the continuous hinge depicted in FIGS. 4 and 5, the fastener head is inserted into the hinge leave aperture until it is flush with the hinge leave and between the ribs on opposite sides of the aperture. At this point where the fastener head is flush with the hinge leave, the ribs act to hold the edges of or facets on the head of the fastener from spinning by constraining the fastener's movement. In the embodiment depicted in FIGS. 1–3, the ribs are positioned on opposite sides of all the apertures of both hinge leaves. In other embodiments, the ribs may be provided on less than all of the hinge leaves and may be provided on the opposite sides of less than all of the apertures. Also, while the ribs in FIGS. 1–3 are shown as continuous, they need not necessarily be so and instead there may be separate ribs for one or more of the apertures. Further, the ribs in FIGS. 1–3 are positioned lengthwise on the hinge leaves. However, as will be apparent to those skilled in the art, ribs may be located at one or more spaced points along the length of one or both hinge leaves and the ribs may be configured in spaced-apart and varying orientations on opposite sides of the one or more apertures of the hinge leaves. FIG. 10 depicts an example embodiment having widthwise spaced-apart ribs. Further, the ribs need not necessarily be spaced-apart on opposite sides of the one or more apertures of the hinge leaves; they simply need to be positioned around the aperture(s) so as to keep an inserted fastener from spinning or moving. FIG. 11 depicts an example embodiment having apertures of the hinge leaves between ribs that are spaced other than on opposite sides of the apertures, particularly at right angles above an aperture in a chevron-type manner so as to match the shape of a portion of a hex head bolt.

Figure 12:
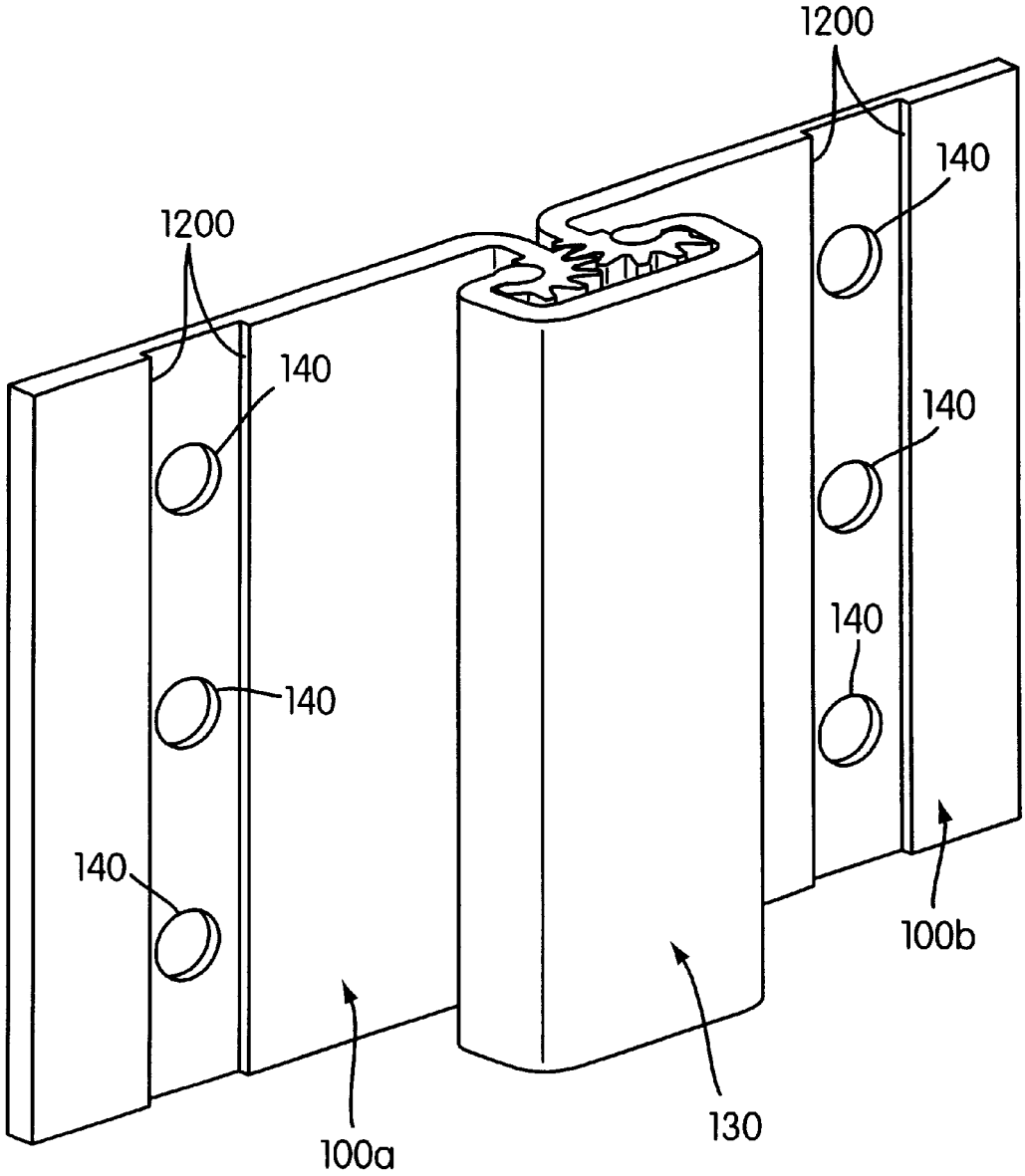
FIG. 12 is a fragmentary perspective view of a hinge having a channel according to at least one embodiment of the present invention.
Figure 13:
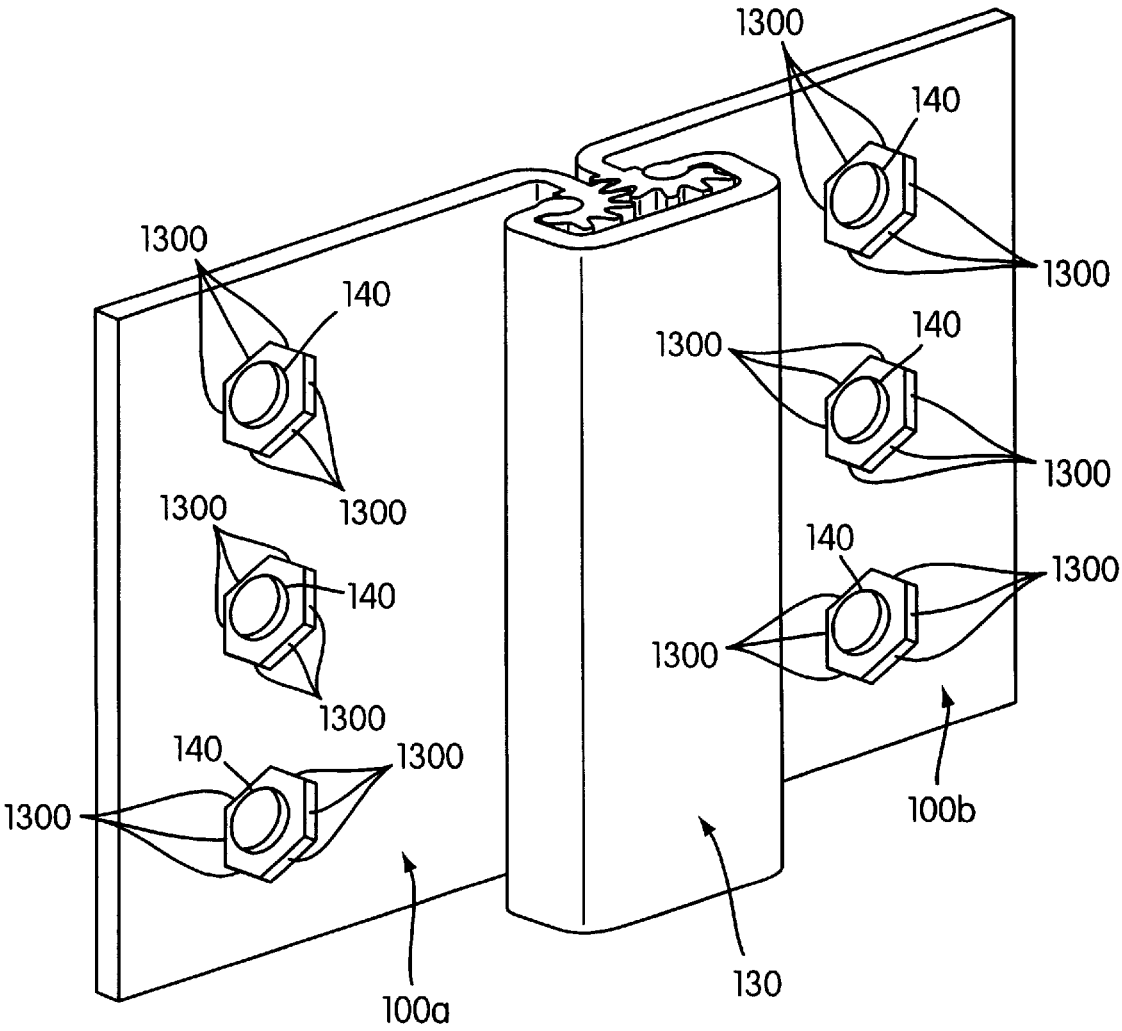
FIG. 13 is a fragmentary perspective view of a hinge having a hexagon-type recess according to at least one embodiment of the present invention.

As will be apparent to those skilled in the art, the anti-spinning capability can be more generally provided as one or more fastener engaging surfaces on a hinge leaf disposed on the hinge leaf in adjacent relationship to the aperture of the hinge leaf, the at least one engaging surface being spaced from the aperture of the hinge leaf so as to engage a fastener inserted into the aperture from spinning. For example, the ribs of FIGS. 1–11 provide a plurality of fastener engaging surfaces on a hinge leaf between which an aperture of the hinge leaf is positioned, the surfaces of the ribs engaging a facet on the fastener head of a fastener inserted into the aperture and acting to hold the fastener from spinning by constraining the fastener's movement. In an alternative arrangement, a single rib may be provided having a single fastener engaging surface, the surface of the rib engaging a facet on the fastener head of a fastener inserted into the aperture and acting to hold the fastener from spinning by constraining the fastener's movement. Furthermore, referring to FIG. 12 as an example, the hinge leaves may be provided with a channel within which the apertures of the hinges leaves are provided, where each edge 1200 of the channel provides a fastener engaging surface that acts to hold fasteners inserted into the apertures from spinning by constraining the fastener's movement. Similarly, referring to FIG. 13 as an example, the hinge leaves may be provided with a hexagon-type recess which matches the shape of a hex head bolt, the edges 1300 of the recess acting as a fastener engaging surface to hold hex head bolt type fasteners inserted into the apertures from spinning by constraining the bolt's movement. Accordingly, a fastener engaging surface may be any type of surface provided in or on a hinge leaf, whether integrally or separately, that is disposed in adjacent relationship to an aperture of the hinge leaf, the fastener engaging surface engaging a facet on a fastener inserted into the aperture and acting to hold the fastener from spinning by constraining the fastener's movement.

Referring to FIG. 4, the fastener depicted has a hex head bolt having an internal female thread with a corresponding male threaded machine screw. By having internal female thread in the hex head bolt and using a corresponding male threaded machine screw, threaded engagement of the hinge fastener can be substantially provided within the door (and/or door frame) to which the hinge is affixed. Threaded engagement provided substantially within the door (and/or doorframe) minimizes or avoids the need for large fasteners protruding from the door (and/or doorframe) to provide such threaded engagement.

As can be seen with reference to FIGS. 1–7, the hinge according to at least one embodiment of the invention provides anti-spin capability on the side of the door (and/or doorframe) to which the hinge is attached. This configuration can avoid the need to drill large holes through the door (and/or doorframe) to accommodate anti-spinning capability provided through the hole. Similarly, this configuration can avoid the need for extra components (such as a lock washer or bushing) to provide anti-spinning on the other side of the door (and/or doorframe) to which the hinge is attached.

Figure 8:
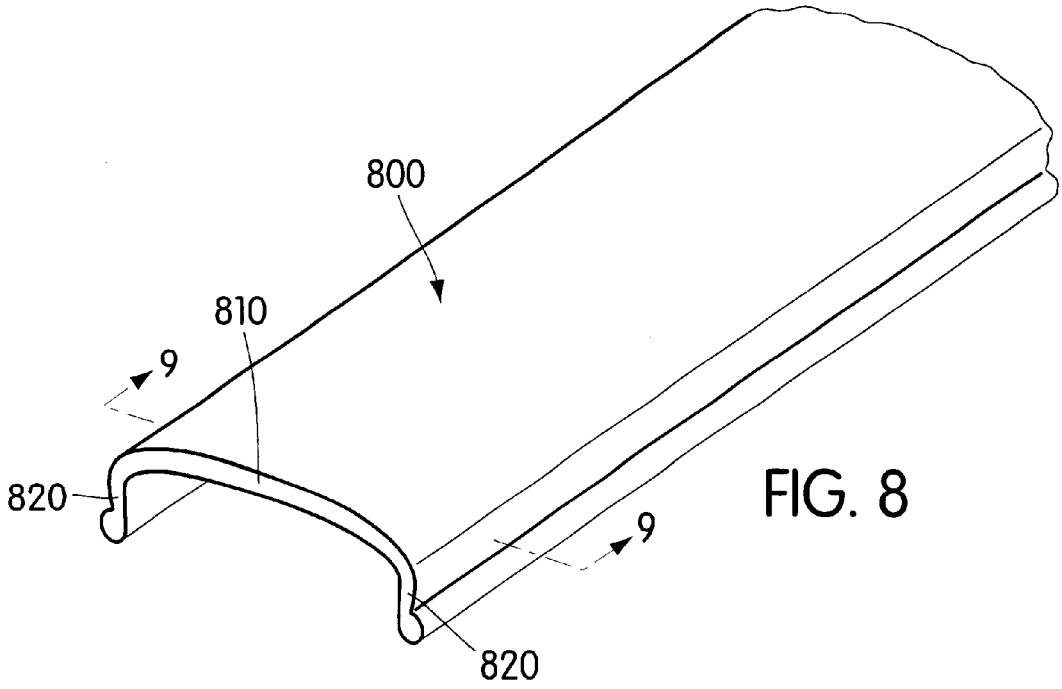
FIG. 8 is a fragmentary perspective view of a cap for a hinge according to at least one embodiment of the present invention.
Figure 9:
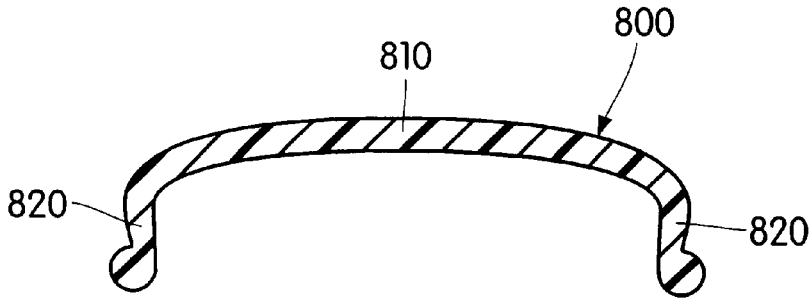
FIG. 9 is a fragmentary sectional view of the cap of FIG. 8 along the line 9—9 of FIG. 8.

In FIGS. 8–9, a cap generally designated by the numeral 800 is illustrated. The cap is applied over the apertures of the hinge assembly to limit entry of water and particulate matter into the hinge assembly and to improve the aesthetics of the hinge. As can be seen, the cap 800 has a dome-shaped top wall 810 and legs 820. The cap is dimensioned to overlie the hinge leaves including the apertures. The legs of the top wall snap into ribs 160 formed in the hinge leaves to hold the cap.

In assembling the hinges of the present invention, the two hinge leaves are placed together with the gear teeth of their pivot portions intermeshed. The lateral bearing member is introduced at one end of the intermeshed leaves and the bosses are slid into the arcuate recesses of the pivot portions.

Although the pivot portions may have varying numbers of gear teeth formed thereabout, generally it is desirable that one of the two members have one less tooth than the other so as to enable optimum operation without any tendency for binding. In practice, a combination of the five-tooth pivot portion with a four-tooth pivot portion has been found satisfactory.

The hinge leaves are conveniently formed by extrusion since the profile is uniform over the length thereof, and the same is true with respect to the lateral bearing member. As will be apparent to those skilled in the art, other techniques such as milling, machining, boring, drilling, tapping, punching and/or the like may be used, for example, to prepare the hinge.

The material utilized for the elements of the hinge will normally comprise aluminum in order to provide high strength together with lightweight and a high degree of resistance to corrosion. However, other metals and alloys may also be employed as can be synthetic resins or plastics exhibiting a high degree of wear resistance and lubricity including polyimides, polytetrafluoroethylenes, polyacetals (both homopolymers and copolymers with silicones) and polypropylene.

Figure 14:
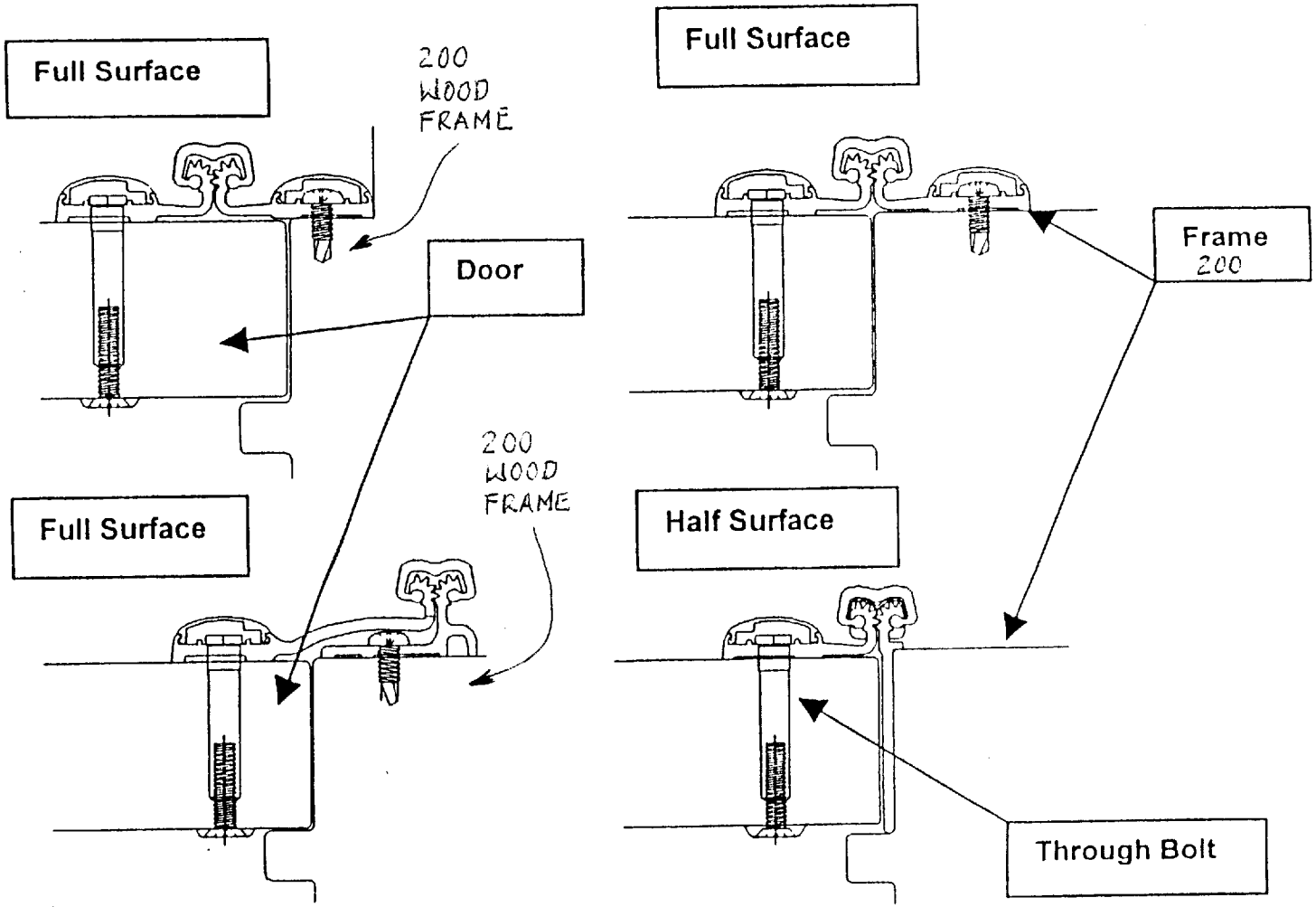
FIG. 14 is a fragmentary sectional view of a number of implementations of a hinge according to at least one embodiment of the present invention.

In FIG. 14, a number of implementations of a hinge according to at least one embodiment of the present invention are depicted. The top two implementations depict full-surface installations of the hinge on a door and frame. In each of those implementations, one of the hinge leaves is affixed to the door using through-bolts having a hex type head. The hex head of the through-bolt cooperates with the fastener engaging surfaces of the ribs of the hinge leaf fastened to the door to prevent the spinning of the through-bolt portion of the fastener when the screw portion of the fastener is threadedly engaged into the through-bolt. In each of the top two implementations, the other hinge leaf is affixed to the frame using conventional screws having a round type head. The round head of the screw does not cooperate with the fastener engaging surfaces of the ribs of the hinge leaf fastened to the frame (e.g., a wood screw screwed into a wooden frame). Anti-spinning is not needed nor desired for threadedly engaging a screw directly into the frame. Optionally, the hinge leaves of these implementations fastened to the frame using screws may be provided without fastener engaging surfaces. The primary difference between the top two implementations is the positioning of the pivot portions of the hinge relative to the door and frame, the differing positions providing varying door action for opening and closing the door.

In FIG. 14, the bottom left implementation depicts a full-surface installation of the hinge on a door and frame. One of the hinge leaves is affixed to the door using a through-bolt having a hex type head. The hex head of the through-bolt portion of the fastener cooperates with the fastener engaging surfaces of the ribs of the hinge leaf fastened to the door to prevent the spinning of the through-bolt portion when the screw portion is threadedly engaged into the through-bolt. The other hinge leaf is affixed to the frame using a screw having a round type head. The hinge leaf affixed to the frame does not provided one or more fastener engaging surfaces, although it may have such surfaces like the top two implementations in FIG. 14 provided. In this full surface implementation, the pivot portions of the hinge are positioned over the frame thus providing another type of door action for opening and closing the door.

In FIG. 14, the bottom right implementation depicts a half-surface installation of the hinge on a door and frame. One of the hinge leaves is affixed to the door using a through-bolt having a hex type head. The hex head of the through-bolt cooperates with the fastener engaging surfaces of the ribs of the hinge leaf fastened to the door to prevent the spinning of the through-bolt when the screw is threadedly engaged into the through-bolt. The other hinge leaf is affixed to the frame by, for example, welding or glue. The hinge leaf affixed to the frame does not provided one or more fastener engaging surfaces, although it may have such surfaces like the top two implementations in FIG. 14 provided.

Thus, it can be seen from the foregoing detailed specification and attached drawings that the hinge of the present invention provides, among other things, anti-spinning capability for fasteners inserted into the apertures of the hinge. The hinge may be relatively easily and economically fabricated and assembled to provide a hinge with anti-spinning capability.

Although continuous hinge embodiments of the present invention have been described herein with reference to FIGS. 1–13, it should be understood that the present invention is not limited to continuous hinges and can apply to hinges generally (or any other apparatuses). Indeed, while this invention has been described in relation to certain embodiments, it will be understood by those skilled in the art that other embodiments according to the generic principles disclosed herein, modifications to the disclosed embodiments and changes in the details of construction, arrangement of parts, compositions, processes, structures and materials selection all may be made without departing from the spirit and scope of the invention. Changes, including equivalent structures, acts, materials, etc., may be made, within the purview of the appended claims, without departing from the scope and spirit of the invention in its aspects. Thus, it should be understood that the above described embodiments have been provided by way of example rather than as a limitation of the invention and that the specification and drawing(s) are, accordingly, to be regarded in an illustrative rather than a restrictive sense. As such, the invention is not intended to be limited to the embodiments shown above but rather is to be accorded the widest scope consistent with the principles and novel features disclosed in any fashion herein.

What is claimed is:

1. A continuous hinge assembly comprising:

first and second pivotally connected hinge leaves, the first hinge leaf being constructed and arranged to be secured to a frame;

a fastener constructed and arranged to be inserted through an aperture in the second hinge leaf, the fastener to be inserted in the aperture having two fastener members including a first member having a head with a non-circular peripheral surface and a second member constructed and arranged to be threadedly secured to the first member; and a fastener engaging surface disposed on the second hinge leaf in adjacent relationship to the aperture in the second hinge leaf, the fastener engaging surface being spaced from the aperture so as to engage the peripheral surface of the fastener inserted into the aperture and prevent said first member from spinning when said second member is secured to said first member.

2. The hinge assembly of claim 1, wherein each of the hinge leaves comprise a pivot portion extending along the abutting edge of the hinge leaves, the pivot portions having convexly arcuate surfaces with intermeshing gear teeth extending along the length thereof.

3. The hinge assembly of claim 2, further comprising a lateral bearing member of generally C-shaped cross section providing an axially extending cavity therewithin and opposed flanges at its free ends, the cavity receiving the pivot portions and the flanges extending into channels of the pivot portions to lock the hinge leaves with their pivot portions in intermeshing engagement, the hinge leaves being pivotable relative to each other about their abutting geared surfaces within the cavity of the lateral bearing member.

4. The hinge assembly of claim 3, wherein the channels in the hinge leaves provide arcuate surfaces and the flanges of the lateral bearing member have cooperating arcuate surfaces.

5. The hinge assembly of claim 1, wherein the pivot portions of the hinge leaves are of generally C-shaped cross section with the gear teeth being formed in the outer surface.

6. The hinge assembly of claim 1, wherein the second hinge leaf comprises a plurality of axially extending ribs projecting from the second hinge leaf in spaced relationship to the aperture of the second hinge leaf, and between which the aperture is seated.

7. The hinge assembly of claim 6, further comprising a cap having a generally C-shaped wall and the wall having recesses in which the ribs are seated to mount the cap onto the second hinge leaf, wherein the ribs are spaced apart so as to retain the cap in a position covering the aperture of the second hinge leaf.

8. The hinge assembly of claim 1, wherein the first member comprises a bolt with an internal female thread and the second member comprises a screw for threaded engagement into the bolt.

9. The hinge assembly of claim 1, wherein the fastener engaging surface comprises surfaces of at least one engaging rib projecting from the second hinge leaf in spaced relationship to the aperture and between which the aperture is seated.

10. The hinge assembly of claim 1, wherein the fastener engaging surface comprises a plurality of edges recessed in the second hinge leaf in spaced relationship to the aperture and between which the aperture is seated.

11. The hinge assembly of claim 1, wherein the fastener engaging surface comprises surfaces of at least one engaging rib in a chevron-type relationship around the aperture.

12. A continuous hinge, comprising:

first and second hinge leaves each having an aperture;

pivot portions pivotally coupling the first and second hinge leaves, the pivot portions having intermeshing gear teeth extending along the length thereof;

a lateral bearing member providing an axially extending cavity therewithin and opposed flanges at its free ends, the cavity receiving the pivot portions and the flanges extending into channels of the pivot portions to lock the first and second hinge leaves with their pivot portions in intermeshing engagement, the first and second hinge leaves being pivotable relative to each other about their intermeshing gear teeth within the cavity of the lateral bearing member; and a fastener engaging surface disposed on at least one of the first and second hinge leaves in adjacent relationship to the aperture of the at least one of the first and second hinge leaves, the fastener engaging surface being spaced from the aperture so as to engage a fastener inserted into the aperture and prevent the fastener from spinning.

13. The continuous hinge of claim 12, wherein the hinge leaves each comprise a plurality of axially extending ribs projecting from the hinge leaves in spaced relationship to the aperture of each of the hinge leaves, and between which the aperture is seated.

14. The continuous hinge of claim 13, further comprising a plurality of caps each having a generally C-shaped wall and the wall having recesses in which the ribs are seated to mount each of the caps onto each of the hinge leaves, wherein the ribs are spaced apart so as to retain each of the caps in a position covering the aperture of each of the hinge leaves.

15. The continuous hinge of claim 12, further comprising a plurality of fasteners constructed and arranged to be inserted through associated ones of the apertures, the fasteners having two fastener members including a first member having a head with a non-circular, multi-faceted peripheral surface and a second member constructed and arranged to be threadedly secured to the first member.

16. The continuous hinge of claim 15, wherein the first member comprises a bolt with an internal female thread and the second member comprises a screw for threaded engagement into the bolt.

17. The continuous hinge of claim 12, wherein the fastener engaging surface comprises surfaces of at least one engaging rib projecting from the at least one of the first and second hinge leaves in spaced relationship to the aperture and between which the aperture is seated.

18. The continuous hinge of claim 12, wherein the fastener engaging surface comprises a plurality of edges recessed in the at least one of the first and second hinge leaves in spaced relationship to the aperture and between which the aperture is seated.

19. The continuous hinge of claim 12, wherein the fastener engaging surface comprises surfaces of at least one engaging rib in a chevron-type relationship around the aperture.

20. A continuous hinge, comprising:

a pair of abutting hinge leaves each having an aperture; and at least one fastener engaging surface disposed on at least one of the hinge leaves in adjacent relationship to the aperture of the hinge leaves, the at least one fastener engaging surface being spaced from the aperture of the hinge leaves so as to engage a fastener inserted into the aperture and prevent the fastener from spinning.

21. The hinge of claim 20, further comprising a plurality of fasteners constructed and arranged to be inserted through an associated aperture, each at least one fastener having two fastener members including a first member having a head with a non-circular, multi-faceted peripheral surface and a second member constructed and arranged to be threadedly secured to the first member.

22. The hinge of claim 21, wherein the first member comprises a bolt with an internal female thread and the second member comprises a screw for threaded engagement into the bolt.

23. The hinge of claim 20, wherein the at least one fastener engaging surface comprises surfaces of at least one engaging rib projecting from at least one of the hinge leaves in spaced relationship to the aperture and between which the aperture is seated.

24. The hinge of claim 20, wherein the at least one fastener engaging surface comprises a plurality of edges recessed in at least one of the hinge leaves in spaced relationship to the aperture and between which the aperture is seated.

25. The hinge of claim 20, wherein the at least one fastener engaging surface comprises surfaces of at least one engaging rib in a chevron-type relationship around the aperture.

26. A continuous hinge assembly, comprising:

a first hinge leaf having at least one aperture therethrough;

a second hinge leaf having at least one aperture therethrough;

a first fastener constructed and arranged to be inserted through said at least one first hinge leaf aperture;

a second fastener constructed and arranged to be inserted through said at least one second hinge leaf aperture, said second fastener having first and second fastener portions, said first fastener portion having a fastener head, said fastener head having a non-circular, multi-sided peripheral surface, said second fastener portion being constructed and arranged to be threadedly secured to the first fastener portion; and said second hinge leaf having a fastener head engaging surface positioned adjacent said at least one second hinge leaf aperture, said fastener head engaging surface constructed and arranged to engage said multi-sided peripheral surface of said fastener head to prevent rotation of said first fastener portion during threaded securement of said second fastener portion to said first fastener portion.

27. The hinge assembly of claim 26, wherein each of said hinge leaves comprise a pivot portion extending along an abutting edge of said hinge leaves, said pivot portions having convexly arcuate surfaces with intermeshing gear teeth extending along the length thereof.

28. The hinge assembly of claim 27, further comprising a lateral bearing member of generally C-shaped cross section providing an axially extending cavity therewithin and opposed flanges at its free ends, the cavity receiving said pivot portions and said flanges extending into channels of said pivot portions to lock said hinge leaves with their said pivot portions in intermeshing engagement, said hinge leaves being pivotable relative to each other about their abutting geared surfaces within said cavity of said lateral bearing member.

29. The hinge assembly of claim 26, wherein said hinge leaves comprise a plurality of axially extending ribs projecting from each of said hinge leaves in spaced relationship to the at least one aperture of each of said hinge leaves, and between which the at least one aperture is seated.

30. The hinge assembly of claim 29, further comprising a plurality of caps each having a generally C-shaped wall and the wall having recesses in which the ribs are seated to mount each of the caps onto said hinge leaves, wherein the ribs are spaced apart so as to retain each of the caps in a position covering the at least one aperture of each of said hinge leaves.

31. The hinge assembly of claim 26, wherein said first fastener portion comprises a bolt with an internal female thread and said second fastener portion comprises a screw for threaded engagement into said bolt.

32. The hinge assembly of claim 26, wherein said fastener engaging surface comprises surfaces of at least one engaging rib projecting from said second hinge leaf in spaced relationship to the at least one aperture and between which the at least one aperture is seated.

33. The hinge assembly of claim 26, wherein said fastener engaging surface comprises a plurality of edges recessed in the second hinge leaf in spaced relationship to the at least one aperture and between which the at least one aperture is seated.

34. The hinge assembly of claim 26, wherein said fastener engaging surface comprises surfaces of at least one engaging rib in a chevron-type relationship around the at least one aperture.

35. A door assembly, comprising:

a mounting structure;

a door structure;

a first continuous hinge leaf having at least one aperture therethrough;

a second continuous hinge leaf having at least one aperture therethrough;

a first fastener constructed and arranged to be inserted through said at least one first hinge leaf aperture and for fastening said first hinge leaf to said mounting structure;

a second fastener constructed and arranged to be inserted through said at least one second hinge leaf aperture and for fastening said second hinge leaf to said door structure, said second fastener having first and second fastener portions, said first fastener portion having a fastener head, said fastener head having a non-circular, multi-sided peripheral surface, said second fastener portion being constructed and arranged to be threadedly secured to said first fastener portion; and said second hinge leaf having a fastener head engaging surface positioned adjacent said at least one second hinge leaf aperture, said fastener head engaging surface constructed and arranged to engage said multi-sided peripheral surface of said fastener head to prevent rotation of said first fastener portion during threaded securement of said second fastener portion to said first fastener portion.

36. The door assembly of claim 35, wherein a first side of said second hinge leaf faces a first side of said door structure, a second side of said second hinge leaf faces away from said first side of said door structure and said second fastener portion has a head disposed on a second side of said door structure.

37. The door assembly of claim 35, wherein each of said hinge leaves comprise a pivot portion extending along an abutting edge of said hinge leaves, said pivot portions having convexly arcuate surfaces with intermeshing gear teeth extending along the length thereof.

38. The door assembly of claim 37, further comprising a lateral bearing member of generally C-shaped cross section providing an axially extending cavity therewithin and opposed flanges at its free ends, said cavity receiving said pivot portions and said flanges extending into channels of said pivot portions to lock said hinge leaves with their said pivot portions in intermeshing engagement, said hinge leaves being pivotable relative to each other about their abutting geared surfaces within said cavity of said lateral bearing member.

39. The door assembly of claim 35, wherein said hinge leaves comprise a plurality of axially extending ribs projecting from each said hinge leaf in spaced relationship to said at least one aperture of each said hinge leaf, and between which said at least one aperture is seated.

40. The door assembly of claim 39, further comprising a plurality of caps each having a generally C-shaped wall and the wall having recesses in which the ribs are seated to mount each of the caps onto each said hinge leaf, wherein said ribs are spaced apart so as to retain each of the caps in a position covering said at least one aperture of each said hinge leaf.

41. The door assembly of claim 35, wherein said first fastener portion comprises a bolt with an internal female thread and said second fastener portion comprises a screw for threaded engagement into said bolt.

42. The door assembly of claim 35, wherein said fastener engaging surface comprises surfaces of at least one engagement rib projecting from said second hinge leaf in spaced relationship to said at least one second hinge leaf aperture and between which said at least one second hinge leaf aperture is seated.

43. The door assembly of claim 35, wherein said fastener engaging surface comprises a plurality of edges recessed in said second hinge leaf in spaced relationship to said at least one second hinge leaf aperture and between which said at least one second hinge leaf aperture is seated.

44. The door assembly of claim 35, wherein said fastener engaging surface comprises surfaces of at least one engagement rib in a chevron-type relationship around said at least one second leaf aperture.

45. The hinge assembly of claim 1, wherein the first hinge leaf comprises a plurality of axially extending ribs projecting from the first hinge leaf in spaced relationship to an aperture of the first hinge leaf, and between which the aperture is seated.

46. The hinge assembly of claim 45, further comprising a cap having a generally C-shaped wall and the wall having recesses in which the ribs are seated to mount the cap onto the first hinge leaf, wherein the ribs are spaced apart so as to retain the cap in a position covering the aperture of the first hinge leaf.

* * * * *